United States Patent [19]

Mathis

[11] 3,946,449

[45] Mar. 30, 1976

[54] WHIRLPOOL JET FOR BATHTUBS

[76] Inventor: Cleo D. Mathis, 1808 Potrero Ave., South El Monte, Calif. 91733

[22] Filed: Mar. 31, 1975

[21] Appl. No.: 563,795

Related U.S. Application Data

[63] Continuation-in-part of Ser. No. 392,046, Aug. 27, 1973, Pat. No. 3,890,855, and a continuation-in-part of Ser. No. 470,369, May 16, 1974, Pat. No. 3,890,856.

[52] U.S. Cl. ..... 4/178; 4/180; 128/66; 138/40; 138/42

[51] Int. Cl.[2] ..... A47K 3/10

[58] Field of Search .. 4/178, 180, 181, 173, 172.17, 4/172.18, 1; 128/66; 138/40, 41, 42–46, 89, 90, 92, 94.3, 94

[56] References Cited

UNITED STATES PATENTS

| | | | |
|---|---|---|---|
| 2,705,329 | 4/1955 | Exton-Porter | 4/173 |
| 2,984,261 | 5/1961 | Kates | 138/46 |
| 3,391,870 | 7/1968 | Nash | 4/180 X |
| 3,396,412 | 8/1968 | Francom | 4/178 X |
| 3,548,815 | 12/1970 | Everston | 4/178 X |
| 3,571,820 | 3/1971 | Jacuzzi | 4/180 |
| 3,614,952 | 10/1971 | Agnellino | 4/178 X |
| 3,628,529 | 12/1971 | Steimle | 4/180 |
| 3,672,532 | 6/1972 | Becker | 138/89 X |

*Primary Examiner*—Henry K. Artis
*Attorney, Agent, or Firm*—Robert C. Comstock

[57] ABSTRACT

A whirlpool jet for bathtubs having a water outlet extending through a circular opening in the bathtub wall and threadedly connected to a housing. The outlet has an annular radial flange abutting against the inside of the bathtub wall. The flange has a pair of diametrically spaced openings for use in rotating the water outlet in mounting the jet on a bathtub by using a circular wrench having a pair of pins which fit within the openings. The periphery of the wrench has knurling for manually rotating the wrench and a square central opening for receiving the square head of a driving tool. A jet outlet control which is rotatably mounted within the outlet has a concave area surrounding the inner end of a water passage in all rotational positions of the control, so that the water flow into the passage is constant. An extension for poured concrete installations is adapted to protrude beyond the edge of the concrete, the protruding portion being discardable.

11 Claims, 9 Drawing Figures

WHIRLPOOL JET FOR BATHTUBS

REFERENCE TO RELATED APPLICATIONS

This application is a continuation-in-part of my copending applications, Ser. No. 392,046 filed Aug. 27, 1973 now U.S. Pat. No. 3,890,655 and Ser. No. 470,369 filed May 16, 1974 now U.S. Pat. No. 3,890,656.

BACKGROUND OF THE INVENTION

1. Field of the Invention

This invention relates to a whirlpool jet outlet for bathtubs which may also be used in therapy tanks, therapy pools, swimming pools and the like.

2. Description of the Prior Art

There are a number of whirlpool jet outlets and outlet structures on the market at the present time, all of which are relatively complex in their structure, installation and operation. They are not readily adaptable to various types of installations and environments. The water outlets of such devices customarily protrude a substantial distance into the bathtub, which is unsightly, is likely to result in accidents and injury and is generally undesirable.

Previous devices which have directional outlets for directing the water flow in different directions have the disadvantage that when the outlet is moved to some angles, particularly extreme angles, the body of the directional outlet member is disposed in the path of the water flow. The body member accordingly tends to block the outgoing water and to created undesirable turbulence in the area of the entrance to the directional outlet.

Existing devices are also difficult to install and customarily require an attaching means connected directly to the wall of the tank or tub.

If devices of the type now on the market are used with poured concrete, it is necessary to hold the thickness of the poured concrete to extremely rigid tolerances, which is both difficult and costly.

Water outlets of the type now in use are not convertible between individual and interconnected air supplies.

SUMMARY OF THE INVENTION

The present invention relates to a whirlpool jet for bathtubs and the like which is an improvement over the prior art.

It is an object of the invention to provide a whirlpool jet which can be tightly installed on the wall of a tub or tank without any screws, bolts or other fastening members extending into the wall of the tank or tub.

It is a more particular object of the invention to provide such an outlet which can be mounted quickly and simply with a special tool to provide a tight, waterproof connection between the outlet and the wall on which it is mounted.

A further object of the invention is to provide a water outlet in which the direction of the water flow into the tub may be varied over an entire 360° range without any interference with the water flow in any rotational position of the directional outlet.

Another object of the invention is to provide a water outlet which is adapted to be converted for use with either an individual or an interconnected air supply.

A further object of the invention is to provide a water outlet which is adapted to be used with a poured concrete wall within an extension which does not require the thickness of the poured concrete wall to be held to a specific dimension with limited tolerances. This avoids the difficulty and expense involved in attempting to rigidly control the thickness of the poured concrete wall.

Another object of the invention is to provide such an extension which is adapted to selectively receive a water return cap for converting it to a water return instead of an outlet.

A further object of the invention is to provide a water outlet which is adapted to be manufactured economically and conveniently of molded plastic material.

The invention also comprises such other objects, advantages and capabilities as will later more fully appear and which are inherently possessed by the invention.

While there is shown in the accompanying drawings a preferred embodiment of the invention, it should be understood that the same is susceptible of modification and change without departing from the spirit of the invention.

DESCRIPTION OF THE PREFERRED EMBODIMENT

Figure 1:
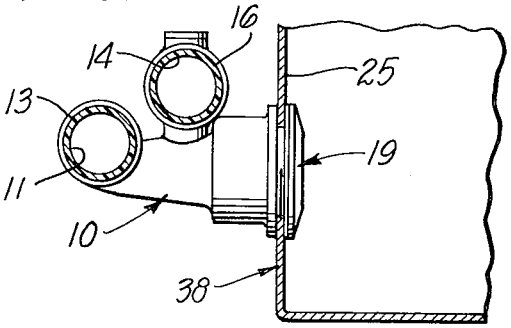
FIG. 1 is a side elevational view of a whirlpool jet installed on a bathtub.
Figure 2:
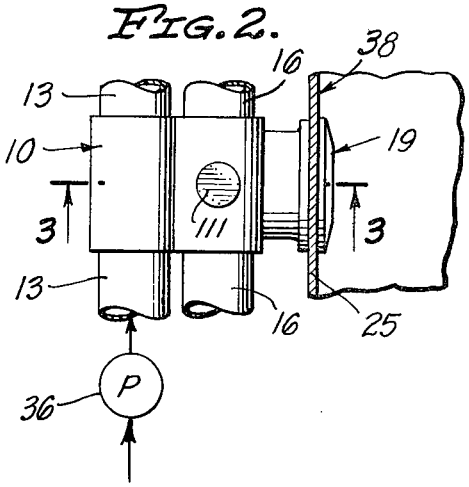
FIG. 2 is a top plan view of the same.
Figure 3:
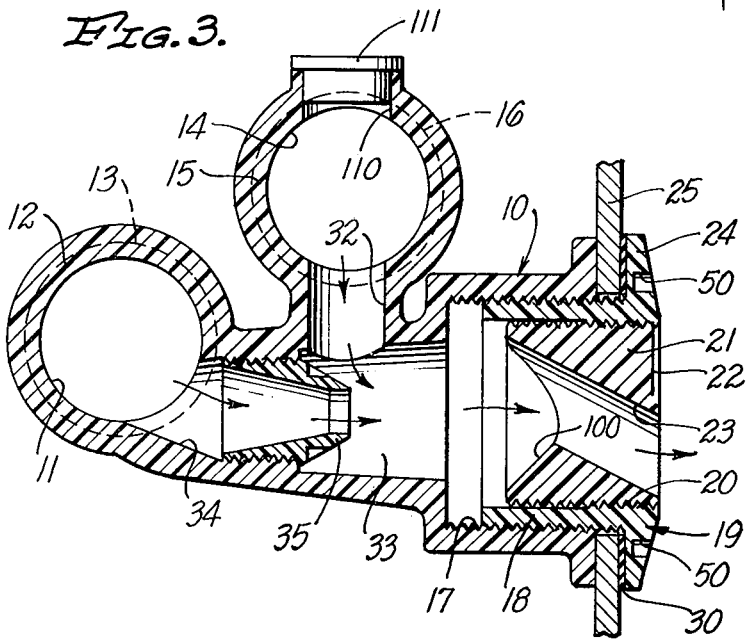
FIG. 3 is an enlarged longitudinal sectional view of the same, taken on line 3—3 of FIG. 2.
Figure 4:
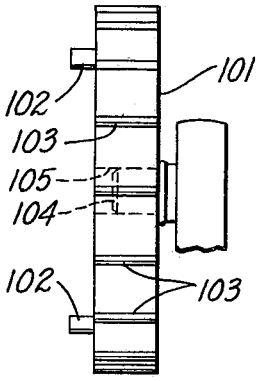
FIG. 4 is a side elevational view of the wrench, with a portion of a driving tool connected thereto.
Figure 5:
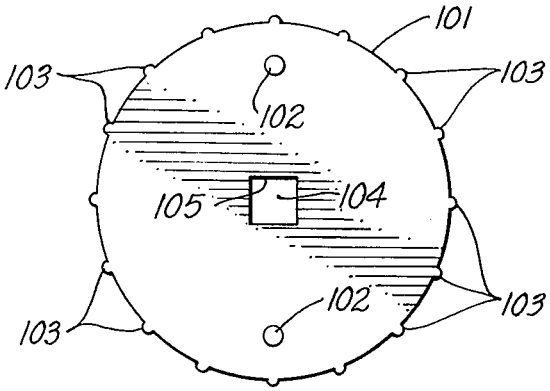
FIG. 5 is a front elevational view of the wrench.
Figure 6:
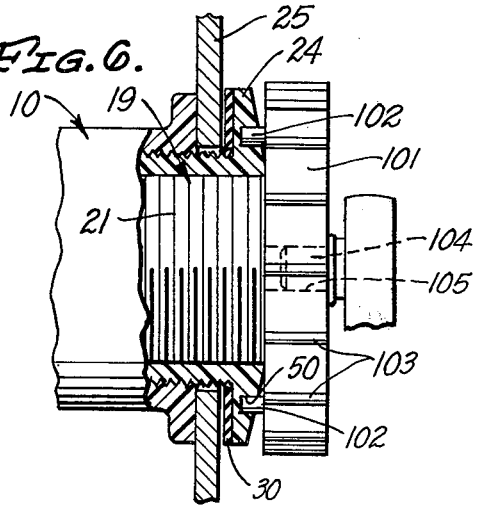
FIG. 6 is a sectional view showing the water outlet being mounted on the bathtub wall with the assistance of the wrench and driving tool.
Figure 7:
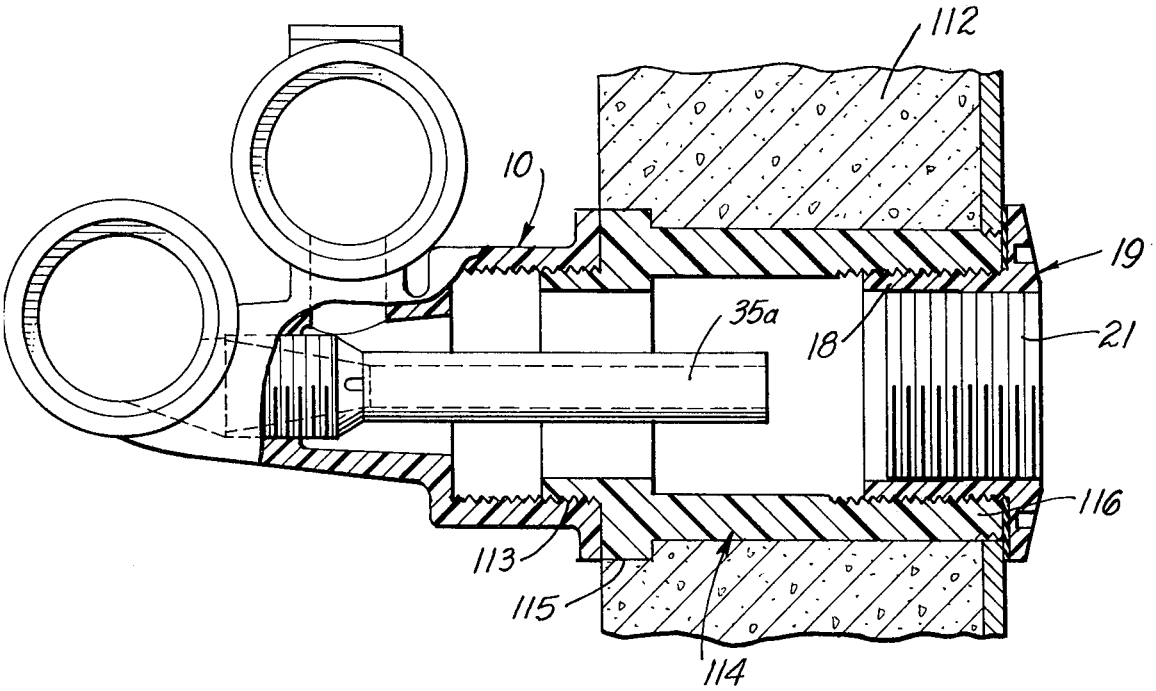
FIG. 7 is an enlarged sectional view similar to FIG. 3, showing the extension and extended nozzle, with the device mounted on a wall.

A preferred embodiment which has been selected to illustrate my invention comprises a main body member or housing 10, which may conveniently be formed of polyvinyl chloride or other suitable material. Extending transversely through the back of the housing 10 is a water inlet opening 11 which is circular in cross-section. A divider 12 of lesser diameter disposed adjacent to the center of the water inlet opening 11 provides a pair of shoulders or abutments on its opposite sides against which the ends of a pair of sections of water supply pipe 13 abut. The pipe 13 may also be conveniently formed of polyvinyl chloride. The walls of the pipe 13 are preferably substantially equal in thickness to the thickness of the divider 12. The inner diameter of the water inlet opening 11 is only slightly larger than the outer diameter water supply pipe 13, so that they can be cemented together to form a permanent connection.

Disposed upwardly and outwardly from the water inlet opening 11 is an air inlet opening 14, which also extends tranversely through the housing 10. The air inlet opening 14 is circular in cross-section and has a divider 15 of lesser diameter against which the opposite ends of a pair of sections of an air supply pipe 16 are disposed in abutting engagement. Both sections of the air supply pipe 16 are preferably cemented to the interior of the air inlet opening 14.

The housing 10 is provided adjacent its front portion with an internally screw threaded opening 17, in which is mounted the externally screw threaded shank 18 of a water outlet 19. The water outlet 19 has internal screw threading 20. Rotatably mounted within the outer portion of the outlet 19 is an externally screw threaded substantially cylindrical jet outlet control 21. The outer end of the control 21 is provided with a diametrical slot 22 which may be used to rotate the control within the outlet 19.

The jet outlet control 21 is provided with an angularly directed water passage or channel 23, which extends completely through the control 21. Rotation of the control 21 by means of the slot 22 results in changing the orientation of the channel 23 and thereby changes the direction of flow of water into the tub.

The inner end of said jet outlet control 21 is provided with a concave open area 100 which surrounds the inner end of the channel 23. Rotation of the outlet control 21 to vary the direction of the channel 23 does not affect the concave open area 100, so that there is no interference with the water flow into the inner end of the channel 23 in any rotational position of the outlet control 21. There is likewise no undesirable turbulence resulting from interference with water flow into the channel 23.

The end of the outlet 19 has a wide annular radial flange 24. The wall 25 of the tub 38 is provided with an opening through which the outlet 19 extends, with the edges of the wall 25 being held between the flange 24 and the adjacent end of the housing 10. The flange 24 is provided with a pair of diametrically spaced openings 50 for receiving a wrench for use in installing or removing the device on a tub.

A flat circular washer 30 is mounted directly adjacent to the inner side of the flange 24. The washer 30 preferably covers substantially all of the area of the flange 24. The washer 30 is adapted to be compressed between the flange 24 and the adjacent portion of the wall 25 to provide a watertight seal between the outlet and the tub.

A special tool is designed to provide extremely tight mounting of the water outlet on the tub. The tool comprises a body member 101 which is circular in shape. A pair of pins 102 project tranversely outwardly from one side of the body member 101. The pins 102 are shaped and spaced from each other so that they fit into the openings 50 in the flange 24. The outer periphery of the body member 101 is provided with knurling 103 to assist in manual rotation of the tool.

In installing the water outlet, the tool is placed over the face of the flange 24 with the pins 102 extending into the openings 50. The tool is then manually rotated as far as possible in a clockwise direction. The square lead 104 of an appropriate driving tool such as a ratchet wrench or speed wrench is then inserted into a square opening 105 which extends through the center of the body member 101. This provides the added power which is required to make an extremely tight fit of the flange 24 and washer 30 against the wall 25.

An air passage 32 extends vertically downwardly from the air inlet opening 14 to the rear of a mixing chamber 33 which is disposed within the housing 10 behind the outlet 19. A water passage 34 extends horizontally from the water inlet opening 11 into the mixing chamber 33. The outlet end of the water passage 34 is in the form of a nozzle 35 which may be fixedly or threadedly mounted in the housing 10.

In use, water is forced by pressure from the pump 36 through the water supply pipes 13, water inlet openings 11 and water passages 34 into the mixing chamber 33 of the housing 10. Air is drawn into the mixing chamber 33 through the air passage 32 by venturi action.

The top of the housing 10 which is disposed above the midportion of the air inlet opening 14 is provided with a vertically directed inlet 110, which is adapted to receive the lower end of a vertically directed air supply pipe for converting the outlet to an individual air supply rather than an interconnected air supply. A cap 111 is removably mounted on the opening 110 when the outlet is used with a horizontally directed air inlet pipe 16.

To adapt the outlet for use with a poured concrete vertical wall 112, the outlet is connected to the externally threaded inner end 113 of an extension 114. The extension 114 has an octagonal flange 15 disposed between its inner end 113 and an outer end 116 of somewhat larger diameter. The outer end 116 is provided with internal screw threading which is adapted to receive the shank 18 of the water outlet 19.

The outer end 116 should preferably be somewhat longer than the shank 18 so that a portion of the outer end 116 will always protrude beyond the concrete after the concrete has been poured. This protruding portion is then cut away after the concrete is dry and before the outlet is installed. This avoids the necessity of holding the thickness of the concrete wall to extremely close tolerances, which is difficult and costly.

The outer end 116 of the extension 114 is provided with internal screw threading 117 which is adapted to receive a water outlet 118 identical to the water outlet 19. The outlet 118 is internally threaded to receive a jet outlet control corresponding to the control 21. It may also receive an externally threaded return 119 to convert the unit to a water return instead of a water outlet.

The device can be used in any tank or tub wall through which an opening such as one inch diameter can be drilled, with room on the opposite side of the wall to accommodate the housing 10.

It should be noted that no faucets, balls, jets, or other devices protrude into the bathtub or tank. The only portion of the device which extends inwardly from the wall 25 is the flange 24 of the outlet 19. It is flat and only a small fraction of an inch thick. It cannot cause any personal injury and is not unsightly.

It should be noted that the device of the present invention requires no screws or other fastening members to be attached to the tube.

When the extension 114 is used, it is preferable to use an extended nozzle **35*a*, so that the discharge end of the nozzle will not be spaced too far away from the entrance to the channel 23. The nozzle 35*a* is accordingly comparable in length to the extension 114. If the extension 114 is shortened, the nozzle 35*a*** is shortened approximately the same amount.

Figure 9:
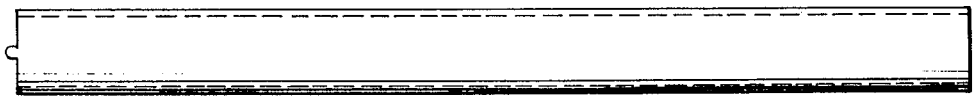
FIG. 9 is a side elevational view of the special wrench used to install and remove the extended nozzle.

In order to install and remove the extended nozzle **35*a*, it is provided with diametrically spaced recesses 120 for removably engaging tabs 121 formed on one end of an elongated hollow wrench 122, which is shown in FIG. 9. The wrench 122 fits around the portion of the extended nozzle 35*a* which is diposed outwardly from the recesses 120. Instead of the recesses 120, the nozzle 35***a* may alternatively be provided with bosses or projections which engage complementary openings formed in the end of the wrench 122.

Figure 8:
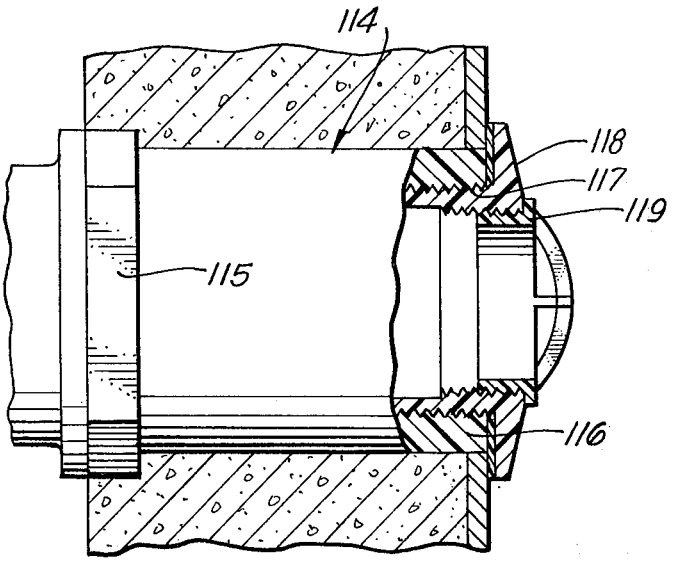
FIG. 8 is a side elevational view, partly in section, showing a water return in use with an extension.

When the water return 119 is used, as shown in FIG. 8, the return 119 may be used as both an inlet and an outlet.

I claim:

1. A whirlpool jet for bathtubs and the like comprising a housing, a chamber formed within said housing, a water inlet connected at one end thereof to a source of water supply under pressure and at the opposite end thereof to the inner end of said chamber, a Venturi air inlet extending through said housing to the inner end of said chamber, whereby the movement of water through said chamber is speeded by a Venturi effect, a water outlet extending through a circular opening in the wall of the bathtub, said water outlet being threadedly mounted within the outer end of said chamber, said water outlet having an annular radial flange, said flange having an inner surface abutting against the inside of the bathtub wall, said housing having a flat outer end abutting against the outside of the bathtub wall, said flange having a pair of diametrically spaced circular openings extending inwardly from its outer face for use in rotating said water outlet with respect to said housing in mounting said jet on a bathtub, and a circular wrench having a pair of transversely directed pins dimensioned and spaced to fit within said openings, the periphery of said wrench having knurling formed thereon for manually rotating said wrench to rotate said water outlet when said pins are mounted in said openings, said wrench having a square opening at the center thereof, said opening being adapted to receive the square head of a tool to rotate said wrench further and bring said flange into tighter engagement with said wall.

2. The structure described in claim 1, and a flat resilient washer disposed directly adjacent to the inner face of said flange, said washer covering substantially the entire area of said flange, said washer being adapted to make sealing engagement with the inner wall of said tub surrounding the opening through which said outlet extends.

3. The structure described in claim 1, and a jet outlet control rotatably mounted within said water outlet, said control having a straight angularly directed water passage extending therethrough, said control being rotatable with respect to said outlet to change the direction of water flow from said jet into said bathtub, and a concave area formed in said control surrounding the inner end of said water passage, said concave area extending transversely to the inner end of said jet outlet control in all rotational positions of said control and passage, so that the amount of water flow into the inner end of said passage is constant for all rotational positions of said control and passage.

4. The structure described in claim 3, said jet outlet control having external threading and being threadedly mounted in said water outlet.

5. The structure described in claim 1, and an extension threadedly connected between said water outlet and said housing, said extension having an externally threaded inner end adapted to fit within the water outlet receiving opening in said housing and an internally threaded outer end adapted to receive said water outlet, said outer end being somewhat longer than the portion of said water outlet which fits therein so that said outer end is adapted to protrude beyond the edge of concrete poured around said extension, the protruding portion of said outer end being discardable so that the thickness of said concrete may vary without affecting the installation of said water outlet in the outer end of said extension.

6. The structure described in claim 5, said water outlet being adapted to receive an externally screw threaded water return cap to change said outlet to a water return inlet.

7. The structure described in claim 5, and an elongated nozzle threadedly mounted in said housing, said nozzle being comparable in length to said extension, the outer end of said nozzle being discardable to adapt the length of said nozzle to the length of said extension.

8. The structure described in claim 1, and a vertically directed inlet extending into the top of said housing above said air inlet opening, said inlet being adapted to receive the lower end of a vertically directed individual air supply pipe.

9. The structure described in claim 8, and a cap adapted to be removably mounted on the upper end of said inlet to close off said inlet when said device is used with a horizontally directed interconnected air supply.

10. A whirlpool jet for bathtubs and the like comprising a housing, a chamber formed within said housing, a water inlet connected at one end thereof to a source of water supply under pressure and at the opposite end thereof to the inner end of said chamber, a Venturi air inlet extending through said housing to the inner end of said chamber, whereby the movement of water through said chamber is speeded by a Venturi effect, a water outlet extending through a circular opening in the wall of the bathtub, said water outlet being threadedly mounted within the outer end of said chamber, an extension threadedly connected between said water outlet and said housing, said extension having an externally threaded inner end adapted to fit within the water outlet receiving opening in said housing and an internally threaded outer end adapted to receive said water outlet, said outer end being somewhat longer than the portion of said water outlet which fits therein so that said outer end is adapted to protrude beyond the edge of concrete poured around said extension, the protruding portion of said outer end being discardable so that the thickness of said concrete may vary without affecting the installation of said water outlet in the outer end of said extension, and an elongated nozzle threadedly mounted in said housing, said nozzle being comparable in length to said extension, the outer end of said nozzle being discardable to adapt the length of said nozzle to the length of said extension.

11. The structure descibed in claim 10, the inner end of said elongated nozzle having means for removably engaging the inner end of an elongated wrench for installing and removing said elongated nozzle, said wrench being hollow and fitting around the portion of said extended nozzle disposed outwardly from said wrench engaging means.

* * * * *